US006398383B1

(12) United States Patent
Huang

(10) Patent No.: US 6,398,383 B1
(45) Date of Patent: Jun. 4, 2002

(54) FLASHLIGHT CARRIABLE ON ONE'S PERSON

(76) Inventor: Yu-Hwei Huang, No. 8, Lane 42, Sec. 2, Nan-Kan Rd., Lou-Choo Hsiang, Tao-Yuan Hsien (TW)

( * ) Notice: Subject to any disclaimer, the term of this patent is extended or adjusted under 35 U.S.C. 154(b) by 0 days.

(21) Appl. No.: 09/698,170

(22) Filed: Oct. 30, 2000

(51) Int. Cl.[7] ..... F21L 4/00
(52) U.S. Cl. ..... 362/202; 362/197
(58) Field of Search ..... 362/202, 203, 362/205, 158, 197–207, 187, 204, 120–253

(56) References Cited

U.S. PATENT DOCUMENTS 4,907,141 A * 3/1990 Wang ..... 362/205
5,485,360 A * 1/1996 Maglica ..... 362/158
5,816,688 A * 10/1998 Shui-Shang ..... 362/253

* cited by examiner

*Primary Examiner*—Sandra O'Shea
*Assistant Examiner*—Bao Truong
(74) *Attorney, Agent, or Firm*—Troxell Law Office PLLC

(57) ABSTRACT

A flashlight carriable on one's person having a hollow main barrel and an end cover, the end cover including an LED, a lamp holder and switching device. One end of a battery set provided in the main barrel is pressed by a spring against the electric conductive cap of the switching device when the end cover is mounted. When the hollow main barrel is rotated relative to the end cover, the LED is turned on or off.

6 Claims, 13 Drawing Sheets

FLASHLIGHT CARRIABLE ON ONE'S PERSON

BACKGROUND OF THE INVENTION

1. Field of the invention

The present invention is related to a flashlight carriable on one's person, and especially to a miniaturized flashlight carriable on one's person and using an LED lamp bulb as the light source, the main members including an internal lamp holder and switching device can be provided in an end cover for combining with a main barrel to form the flashlight having two sections. By controlling by directly rotation of the end cover, the LED lamp bulb can be turned on or off. Otherwise, the end cover can be separated independently from the main barrel for assembling or dismounting batteries.

2. Description of the Prior Art

In a conventional flashlight, a lamp bulb with a tungsten filament and conventional batteries are used and are convenient for holding; however, such a conventional flashlight has quite a large volume and a predetermined length, thus is inconvenient for carrying.

Following nonstop advancing of science and technique of semiconductors, light emitting diodes (LED) without tungsten filaments have been made to have various colors, and can give high brightness and even super high brightness, they have already been able to substitute for the conventional miniature lamp bulbs, and are widely used in products in various fields. Such LED's with small volumes can surely be probable to be used in miniaturizing flashlights. And such flashlights using LED's as light sources can make the length of a flashlight to about 3.5–6 cm and a diameter of about 1.1–2.5 cm.

A conventional lamp bulb has on one end thereof a threaded metallic cap connecting with a lamp holder with an inner thread; while the LED lamp bulb has two terminal electrodes exposed, thereby, a completely different lamp holder is required to connect it in a flashlight.

FIG. 1–3 show a conventional miniature flashlight with an LED lamp bulb as the light source, it is disclosed in U.S. Pat. No. 5,349,506. As shown in FIGS. 1 and 2, such a conventional miniature flashlight has a main barrel 10, the front end thereof is provided with a head assembly 11, while the rear end thereof is provided with a tail cap 12, these members in three sections compose the whole flashlight. The main barrel 10 is connected on the threaded end thereof with a fixing ring 13 to cooperatively position a reflecting condenser 14 and a glass 15. And the LED lamp bulb 16 is located at the center of the reflecting condenser 14. The tail cap 12 is provided on the inner bottom thereof with a spring 17, the main barrel 10 is provided therein with a plurality of batteries 18.

The lamp bulb and the switching device in the flashlight structure stated above are respectively mounted on an upper insulator receptacle 100 and a lower insulator receptacle 120. The main barrel 10 is provided on the front end thereof with a folding-in edge 109, so that the lower insulator receptacle 120 can be received in the interior on the right hand of the folding-in edge 109 as shown in the drawing, while the upper insulator receptacle 100 is located at the left external side of the folding-in edge 109; and that the two insulator receptacles 100 and 120 can be gotten closed to and move apart from each other axially. Referring simultaneously to FIG. 1 and 3, the upper insulator receptacle 100 is provided with two mutually separated through holes 101, 102, and a split hollow pipe formed from two mutually opposite arciform sheets 103, 104. The two terminal electrodes 161, 162 of the LED lamp bulb 16 are extended into the through holes 101, 102, and into the split hollow pipe. While the lower insulator receptacle 120 is provided with two middle slots 121, 122 for insertion of a central conductor 123 and a side conductor 124 respectively. The two insulator receptacles 100 and 120 can allow movement of the arciform sheets 103, 104 to extend into arciform slots 125, 126 to allow the two terminal electrodes 161, 162 to insert to contact the central conductor 123 and the side conductor 124 respectively. The central conductor 123 is provided at one side of the lower insulator receptacle 120 with a bent piece 127 for contact with one end of the battery set 18, and the other end of the battery set 18 presses and contacts the spring 17. The side conductor 124 is provided at the other side of the lower insulator receptacle 120 with another bent piece 128.

The flashlight structure stated above will have the bent piece 128 of the side conductor 124 separated from the folding-in edge 109 of the main barrel 10 when the head assembly 11 is completely locked tightly on the main barrel 10 (as shown in FIG. 1), thus the LED lamp bulb 16 is turned off. While if the head assembly 11 is rotated to screw off a predetermined distance (as shown in FIG. 2), the spring 17 on one side of the tail cap 12 will push to render the bent piece 128 to press the folding-in edge 109 to make a turning on state, and the LED lamp bulb 16 is lightened.

The structure of such a miniature flashlight has been disclosed in many documents such as U.S. Pat. Nos. 5,485,360, No. 5,806,964 and 6,086,219.

However, such a conventional miniature flashlight structure with an LED lamp bulb as the light source has one end thereof fixedly mounted with a head assembly, and has on the rear end thereof a tail cap, it is totally a structure in three sections; these make the flashlight difficult to be further miniaturized. The head assembly must have an internal thread which is slightly larger and connected and locked on an external thread matching therewith on the main barrel. A protrusion portion of the head assembly renders the whole flashlight difficult to make the main barrel and the head assembly integral in their contour. In practical assembling in site, the lower insulator receptacle must be installed into one end of the main barrel, and the upper insulator receptacle is connected at the other end of the main barrel to the lower insulator receptacle, the assembling work is troublesome and inconvenient. The main barrel and the head assembly rotate relatively to each other to control the movement of the upper and the lower insulator receptacles to or apart from each other taking the end where the reflecting condenser locates as a force bearing point, in this mode, operation of controlling is less stable. Before the head assembly is detached or completely mounted, no matter during assembling or maintenance, the LED lamp bulb is in the upright state without covering (such as shown in FIG. 8 of the drawings in U.S. Pat. No. 5,349,506), the expensive LED lamp bulb is extremely subjected to damage by inadvertent collision.

SUMMARY OF THE INVENTION

The object of the present invention is to provide a flashlight carriable on one's person which is comprised lengthwise of a main barrel and an end cover both have their threaded sections adjustable in movement. The end cover has therein a hood for the light emitting diode. The main barrel has in the hollow interior thereof a set of batteries and a lower spring. A male insulation block and a female insulation sleeve are telescopically connected with each other and have therein and therebetween sequentially a metallic electric conductive piece, an electric conductive cap and an upper spring from below upwardly. The male insulation block and the female insulation sleeve telescopically connected with each other can be functioned as a lamp holder for an LED lamp bulb and a switching device. The electric conductive cap can control turning on/off of the LED lamp bulb by press contacting with or separating from the metallic electric conductive piece during rotation control of the end cover. The male insulation block and the female insulation sleeve and the internal elements of the switching device can be integrally provided in the end cover in order to form a flashlight being further miniaturized.

The members in the end cover of the present invention can be assembled sequentially at the same side and in the same direction to thereby render the operation in site faster and more convenient.

The end cover for main elements, the lamp holder and switching device can have an external thread screw connected with an internal thread on the main barrel, so that the whole flashlight can be integral in its contour.

By virtue that the LED lamp bulb is placed in the end cover in a protecting state of being completely covered, it can be assured that the LED lamp bulb will not be damaged accidentally.

Further by virtue that the main controlling members of the flashlight of the present invention can all be hermetically provided in the metallic end cover, the entire structure thereby is firmer and more durable.

The present invention will be apparent in its novelty and features after reading the detailed description of the preferred embodiment thereof in reference to the accompanying drawings.

BRIEF DESCRIPTION OF THE DRAWINGS

FIG. 10 is a schematic view showing the situation of use of the LED of FIG. 9 when it is turned on;

DETAILED DESCRIPTION OF THE PREFERRED EMBODIMENT

Figure 1:
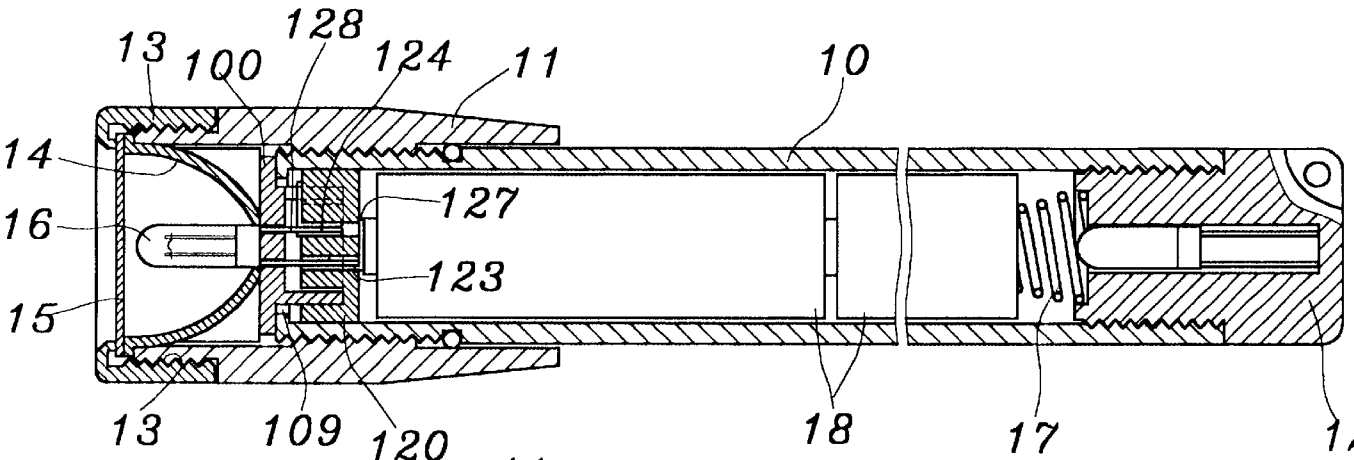
FIG. 1 PRIOR ART
FIG. 1 is a sectional view of the structure of a conventional miniature LED flashlight showing the non-conducting state of an LED lamp bulb.
Figure 2:
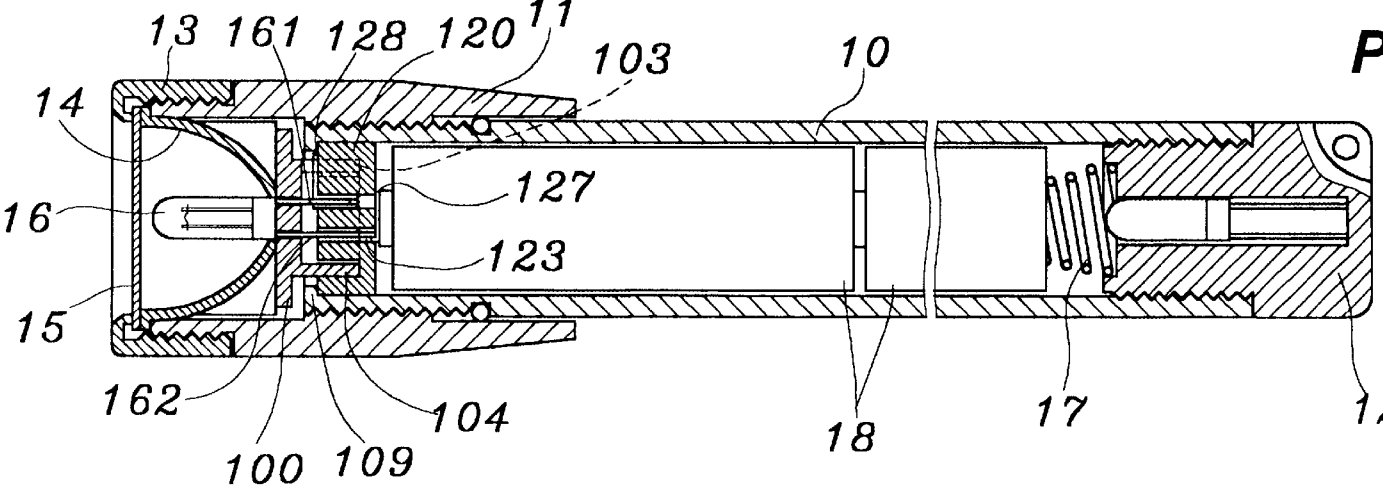
FIG. 2 PRIOR ART
FIG. 2 is a sectional view of the structure of the conventional miniature LED flashlight of FIG. 1 showing the conducting state of the LED lamp bulb.
Figure 3:
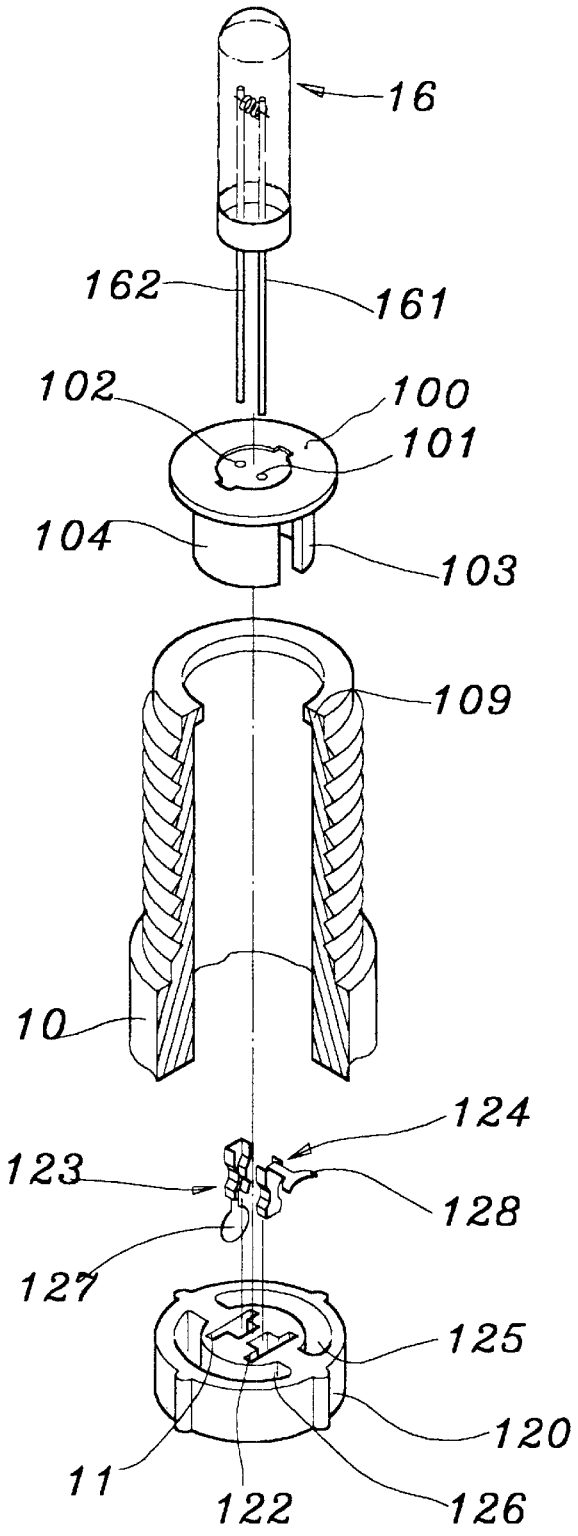
FIG. 3 PRIOR ART
FIG. 3 is an analytic perspective view showing the main elements in FIG. 1.
Figure 4:
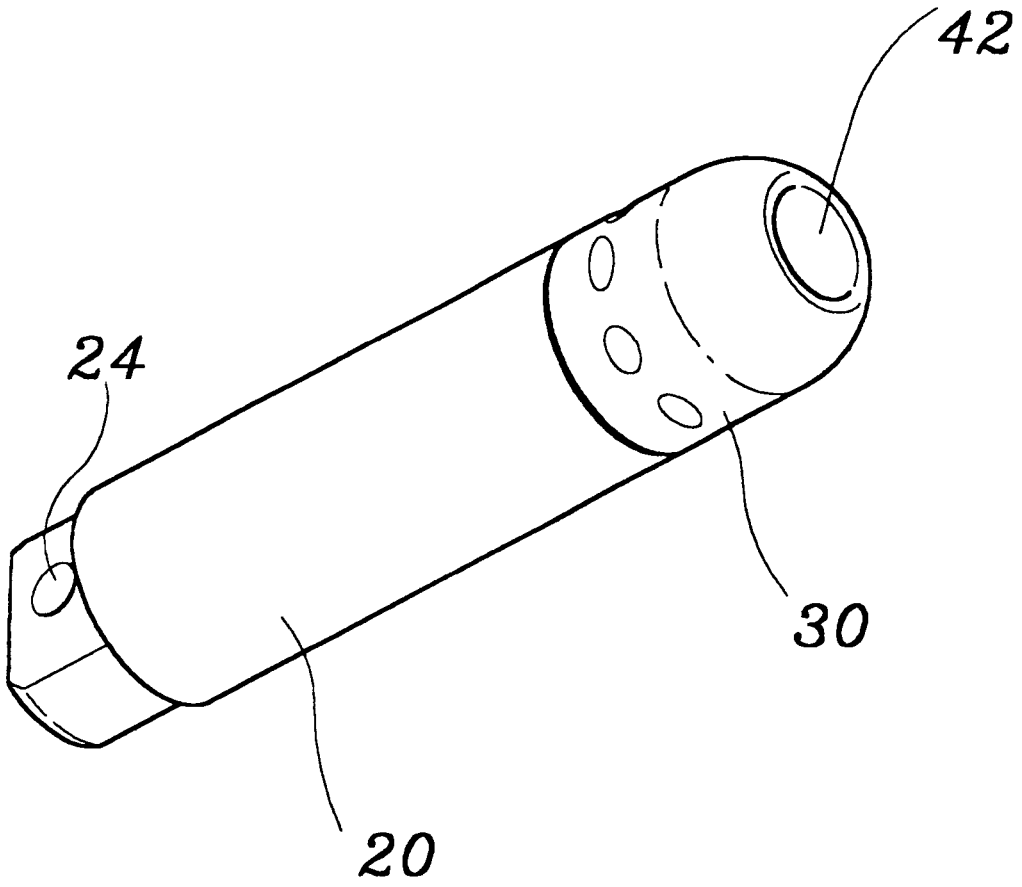
FIG. 4 is a perspective view of the first embodiment of the present invention.
Figure 5:
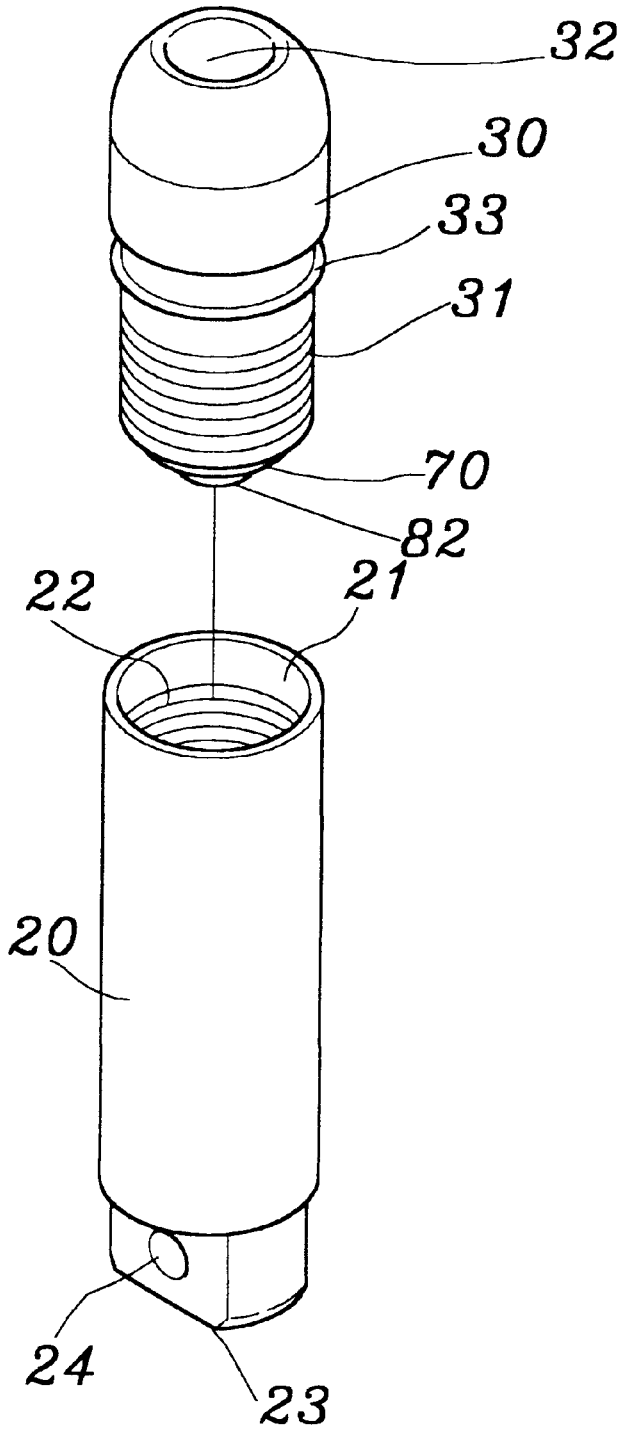
FIG. 5 is an analytic perspective view showing a main barrel and an end cover in FIG. 4.
Figures 6, 6A:
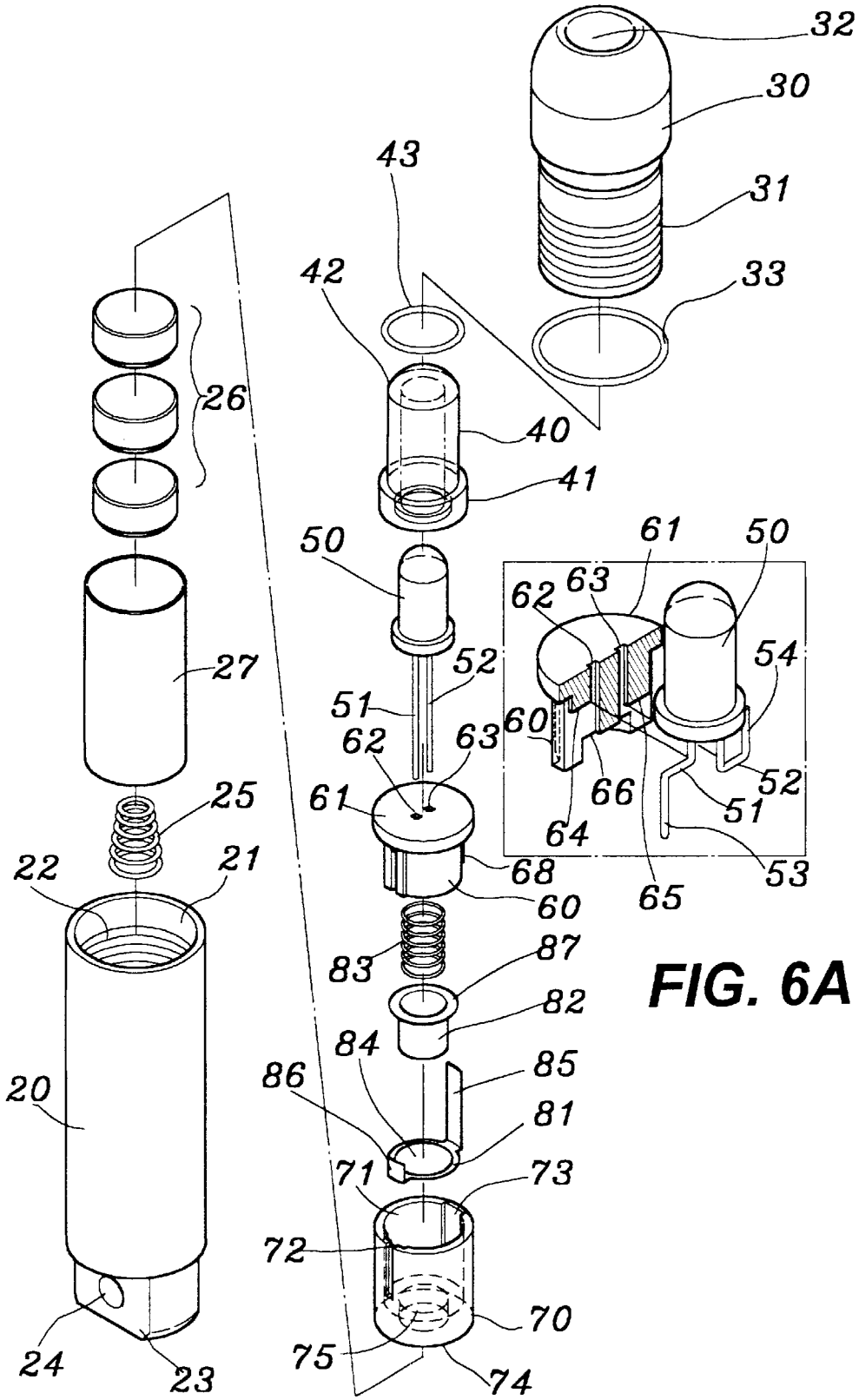
FIG. 6 is an analytic perspective view showing the main elements in FIG. 4.
FIG. 6A is an enlarged drawing showing a male insulation block in a perspective sectional view and showing the LED lamp bulb.

Referring to FIG. 4–6, the present invention has a hollow main barrel 20 with a suitable length and made of metal, the main barrel 20 has an opening 21 on one end thereof, an internal thread 22 is provided near this opening 21; while the other end 23 thereof is a closed end adapted for providing a hole 24 for hanging which can be connected with an article carried on one's person.

An end cover 30 also made of metal can be hollow too, and is provided with an external threaded portion 31 to connect detachably with the internal thread 22 of the cylindrical main barrel 20 with a leakage-proof washer 33 therebetween. The end cover 30 can also be provided with a light penetrating hole 32 to be mounted thereon an LED or a related transparent or reflecting condenser. In the preferred embodiment shown in the drawings, a transparent cover 40 with a stepped flange 41 can be mounted in the end cover 30, the end 42 thereof exposes out from the light penetrating hole 32. The leak-proof washer 43 is provided at a shoulder on the stepped flange 41 and in the end cover 30.

A light emitting diode (LED) 50 can be inserted into the transparent cover 40; the light emitting diode (LED) 50 has two terminal electrodes 51, 52 with suitable lengths.

A male insulation block 60 and a female insulation sleeve 70 together form the lamp holder and switching device. As shown in FIG. 6 and 6A, the male insulation block 60 is provided on the top end of the cylinder like main body thereof with a top lid 61 which is further provided with two through holes 62, 63 on the surface thereof extending through the male insulation block 60 and cooperating with the two terminal electrodes 51, 52. A higher stepped portion 64 and a lower stepped portion 65 are provided on the male insulation block 60 to cooperate with these through holes 62, 63 and the terminal electrodes 51, 52 to be bent and then positioned. The male insulation block 60 is provided on the bottom thereof with a bottom hole 66 with a suitable depth and a suitable diameter (referring to FIG. 6A). The male insulation block 60 further is provided on the peripheral wall of the cylinder like main body thereof with protruding strips 67, 68.

The male insulation block 60 with the structure stated above can be fitted over and connected with the female insulation sleeve 70. As shown in FIG. 6, 7, the female insulation sleeve 70 is provided with an inner bore 71 for insertion therein the cylinder like main body of the male insulation block 60, while the protruding strips 67, 68 provided on the peripheral wall of the male insulation block 60 are connected directionally with inner grooved rails 72, 73 on the lateral walls of the inner bore 71 of the female insulation sleeve 70 in a sliding mode. And the inner bore 71 of the female insulation sleeve 70 is provided on the bottom thereof with a bottom wall 74 of a predetermined thickness, the bottom wall 74 has a central hole 75 with a suitable diameter.

In the interior space formed by the male insulation block 60 and the female insulation sleeve 70, members including sequentially a metallic electric conductive piece 81, an electric conductive cap 82 and an upper spring 83 can be placed to form a desired switching device. The metallic electric conductive piece 81 has a central hole 84 with a suitable diameter and is provided on the periphery thereof oppositely mutually with a long bent foot 85 and a short bent foot 86. The electric conductive cap 82 is formed to have a hollow cylinder with a suitable diameter and with a solid bottom surface, and also is provided with a top edge 87 with a diameter larger than that of the hollow cylinder, so that the hollow cylinder of the electric conductive cap 82 can extend through the central hole 84 in the metallic electric conductive piece 81. The metallic electric conductive piece 81 is opened or closed by the top edge 87 depending on whether the latter is pressed there against. The upper spring 83 is pressed with one end thereof against an inner surface opposite to the solid bottom surface of the electric conductive cap 82, and with the other end thereof against the top of the bottom hole 66. Axial length of the electric conductive cap 82 in this preferred embodiment is lager than the thickness of the bottom wall 74 of the female insulation sleeve 70, this difference allows the top edge 87 of the electric conductive cap 82 to be under control to be pressed against or released from the upper surface of the metallic electric conductive piece 81.

Figure 7:
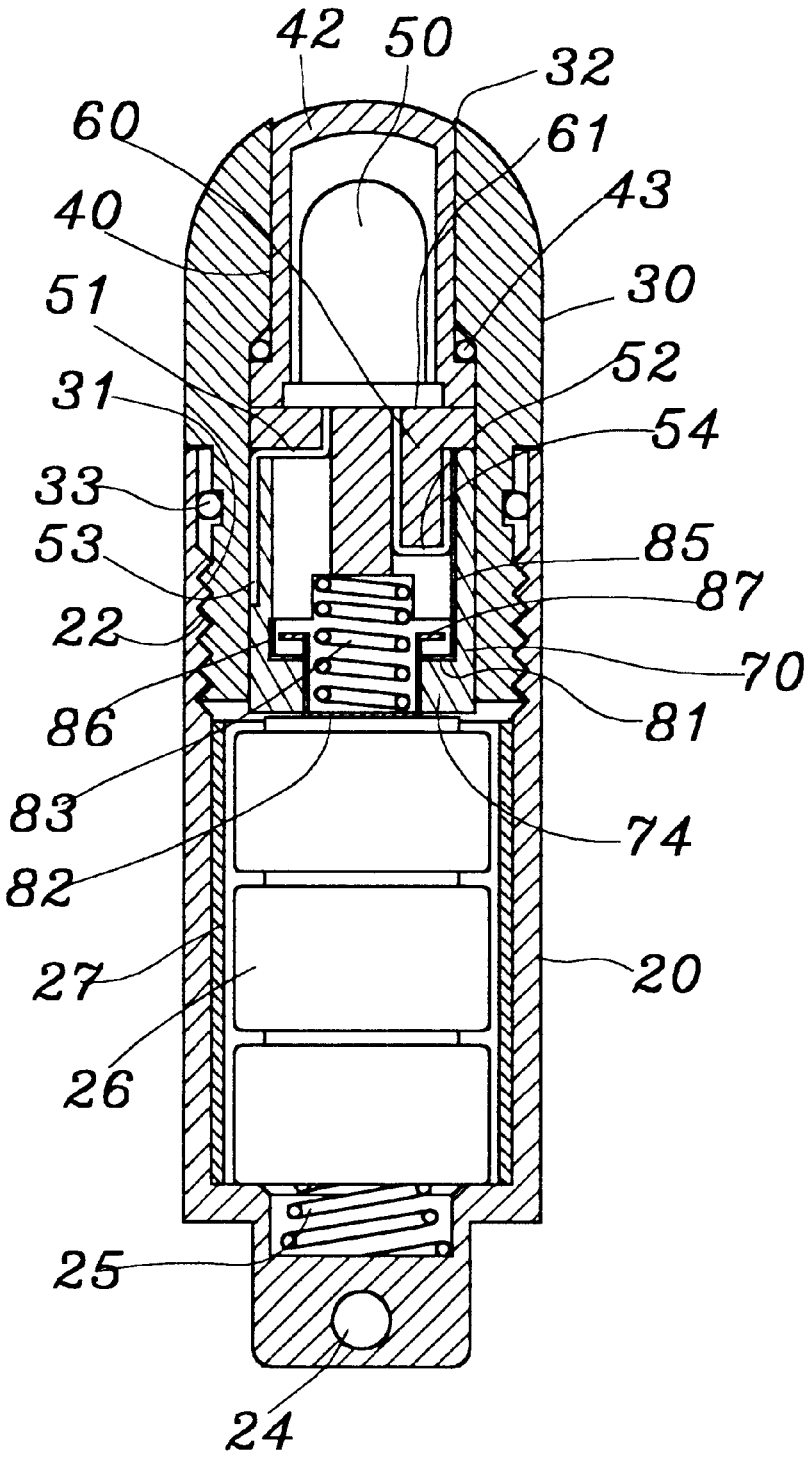
FIG. 7 is a sectional view taken from FIG. 4 showing the turning off state of the LED.
Figure 8:
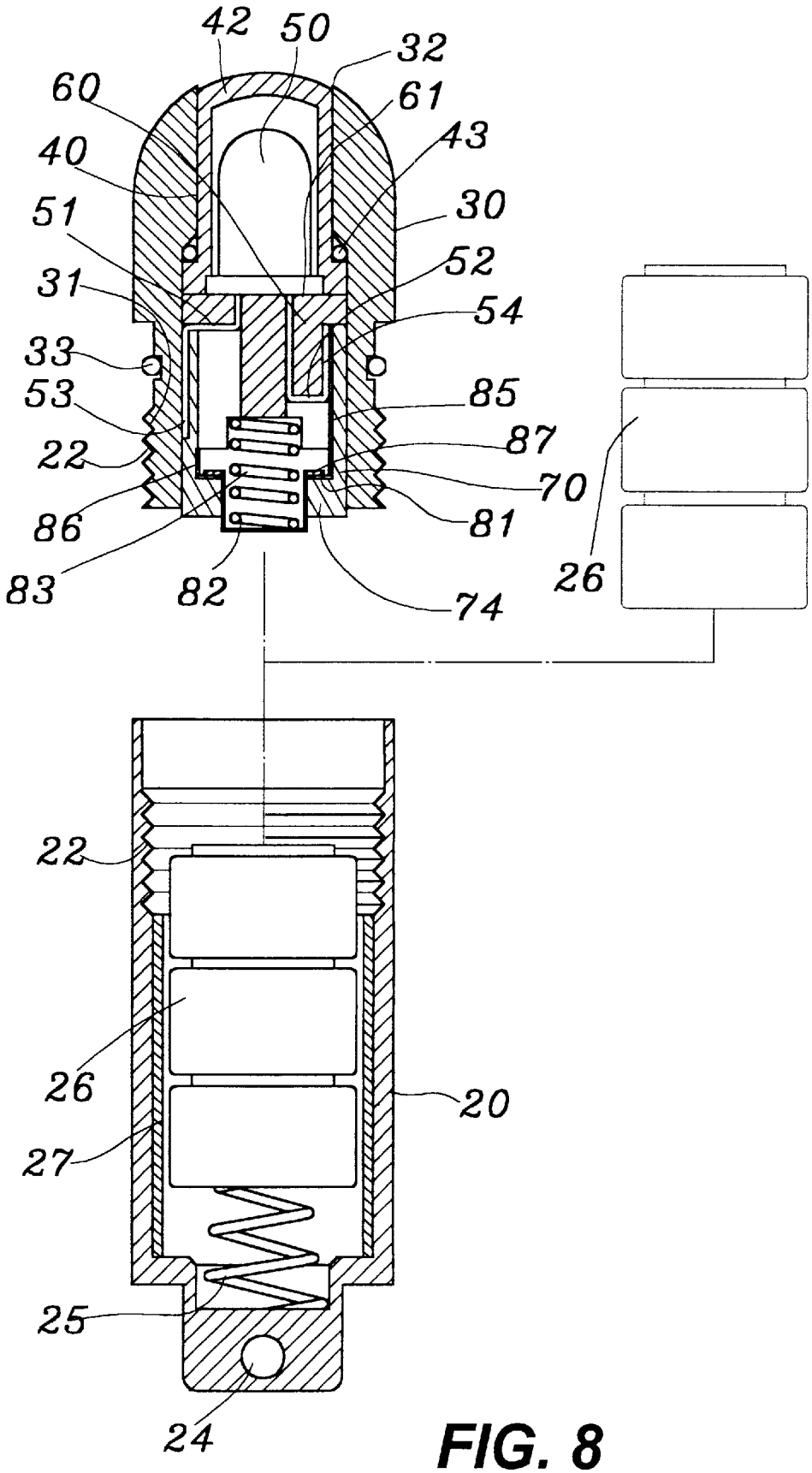
FIG. 8 is a sectional view showing the two mutually separated main barrel and end cover in FIG. 7 in the state of changing or assembling batteries.

Referring now to FIG. 6, 6A and 7, the two terminal electrodes 51, 52 originally extending vertically of the LED 50 are inserted uprightly into the through holes 62, 63 of the male insulation block 60. And then one terminal electrode 51 is bent for 90 degrees and then is further bent downwardly along the higher stepped portion 64 of the male insulation block 60; while the other terminal electrode 52 is bent for 90 degrees and then is further bent upwardly along the lower stepped portion 65 of the male insulation block 60. Thereby, a down bending end 53 of the terminal electrode 51 is pressed against the inner wall of the end cover 30, while an up bending end 54 of the other terminal electrode 52 is pressed against the long bent foot 85 of the metallic electric conductive piece 81.

As shown in FIG. 5, 8, the lamp holder and switching device formed by the male insulation block 60, the female insulation sleeve 70, the metallic electric conductive piece 81, the electric conductive cap 82 and the upper spring 83 can be integrally forcedly combined in the end cover 30 together with the LED lamp bulb 50 and the transparent cover 40. In this way, the end cover 30 will be a unit before it is connected with the main barrel 20, the front end thereof only has the end 42 of the transparent cover 40 exposed, while the bottom end thereof only has the electric conductive cap 82 exposed.

The hollow main barrel 20 can be placed therein sequentially a lower spring 25, a battery set 26 and an insulation sleeve 27 formed from a thin film. One end of the battery set 26 is pressed against the top end of the lower spring 25, the other end thereof contacts the bottom of the electric conductive cap 82 exposed out of the central hole 84 in the metallic electric conductive piece 81. The other end of the lower spring 25 abuts on the bottom of a recess provided in the main barrel 20.

Figure 9:
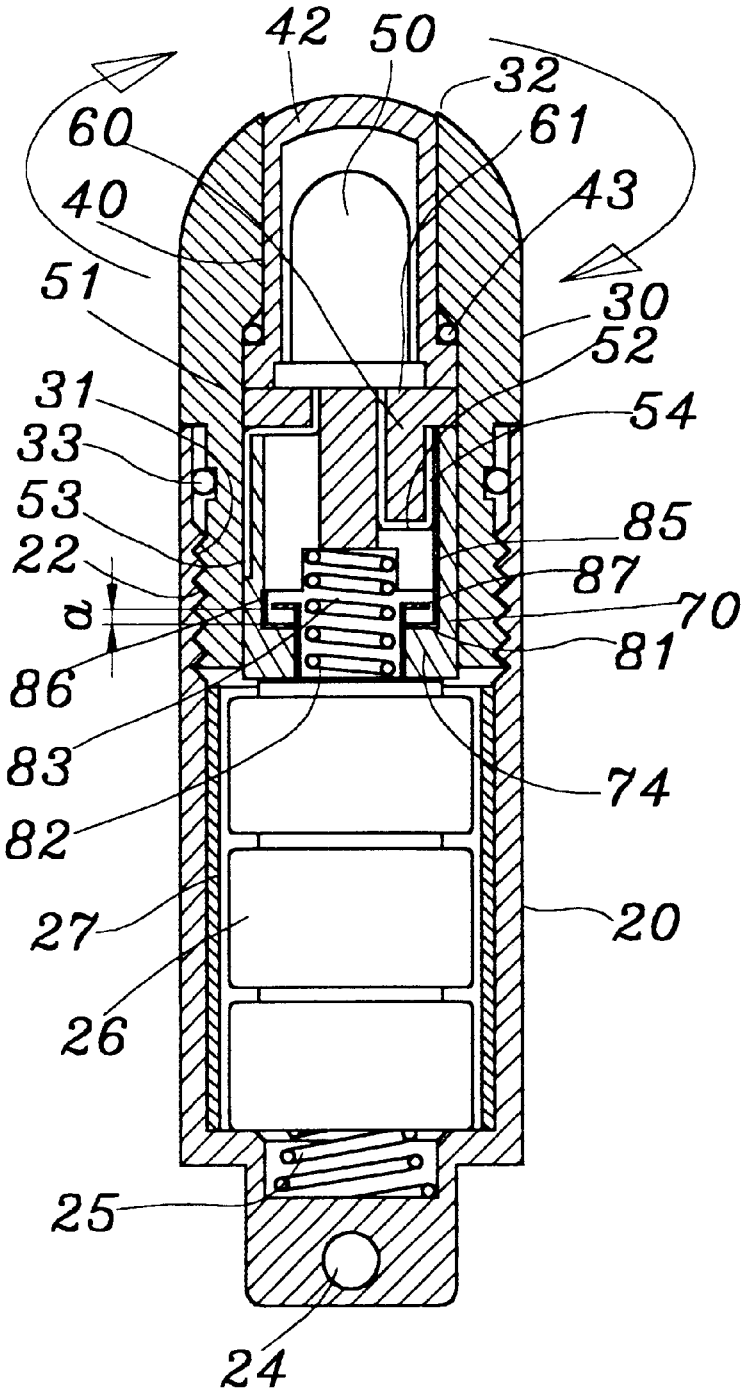
FIG. 9 is a sectional view as that of FIG. 7 showing the end cover is rotated to turn on the LED.
Figure 10:
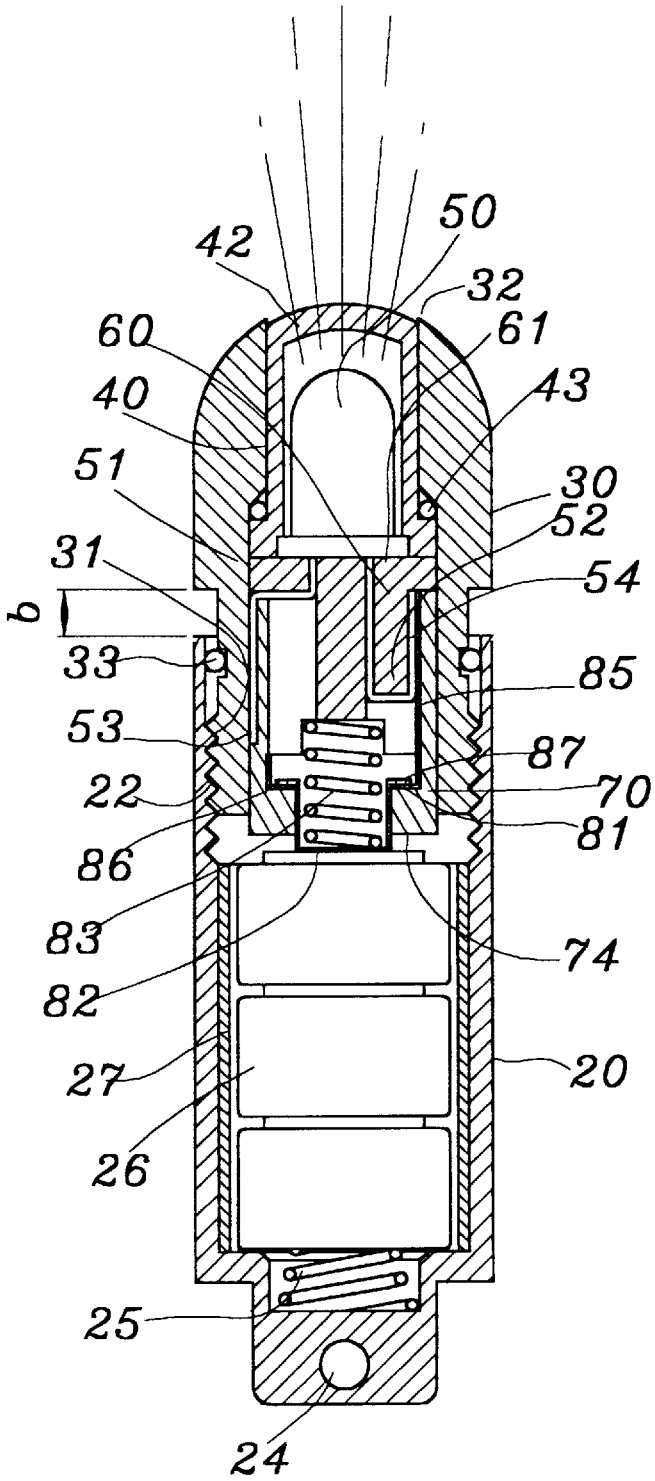

As shown in FIG. 9, when the main barrel 20 and the end cover 30 are gotten closed to each other to be tightly locked, the top edge 87 of the electric conductive cap 82 is raised by pressing of the lower spring 25 beneath the battery set 26, thereby, it keeps a distance "a" from the surface of the metallic electric conductive piece 81, in this mode, the LED lamp bulb 50 is not conducted and is not lightened. When the main barrel 20 and the end cover 30 are rotated to move apart from each other for a distance "b", the whole electric conductive cap 82 is pressed by the upper spring 83, so that the top edge 87 presses against the surface of the metallic electric conductive piece 81, a in this mode, the LED lamp bulb 50 is conducted and is lightened (referring to FIG. 10).

Figure 11:
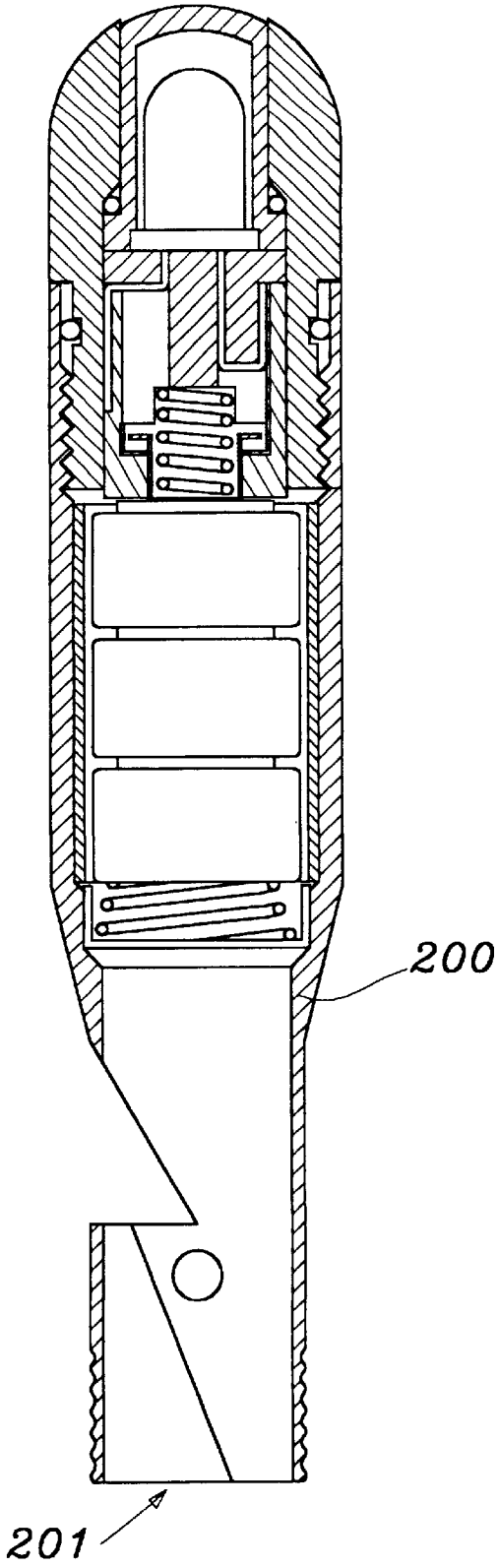
FIG. 11 is a sectional view of the second embodiment of the present invention showing the LED lamp bulb in its turning off state.

The embodiment in the above statement can be modified to get a second embodiment as shown in FIG. 11 which can be a whistle 201 formed integrally on the end of a main barrel 200. The miniaturized flashlight with an LED lamp bulb can be used as a whistle on one's person when in an emergency.

Figure 12:
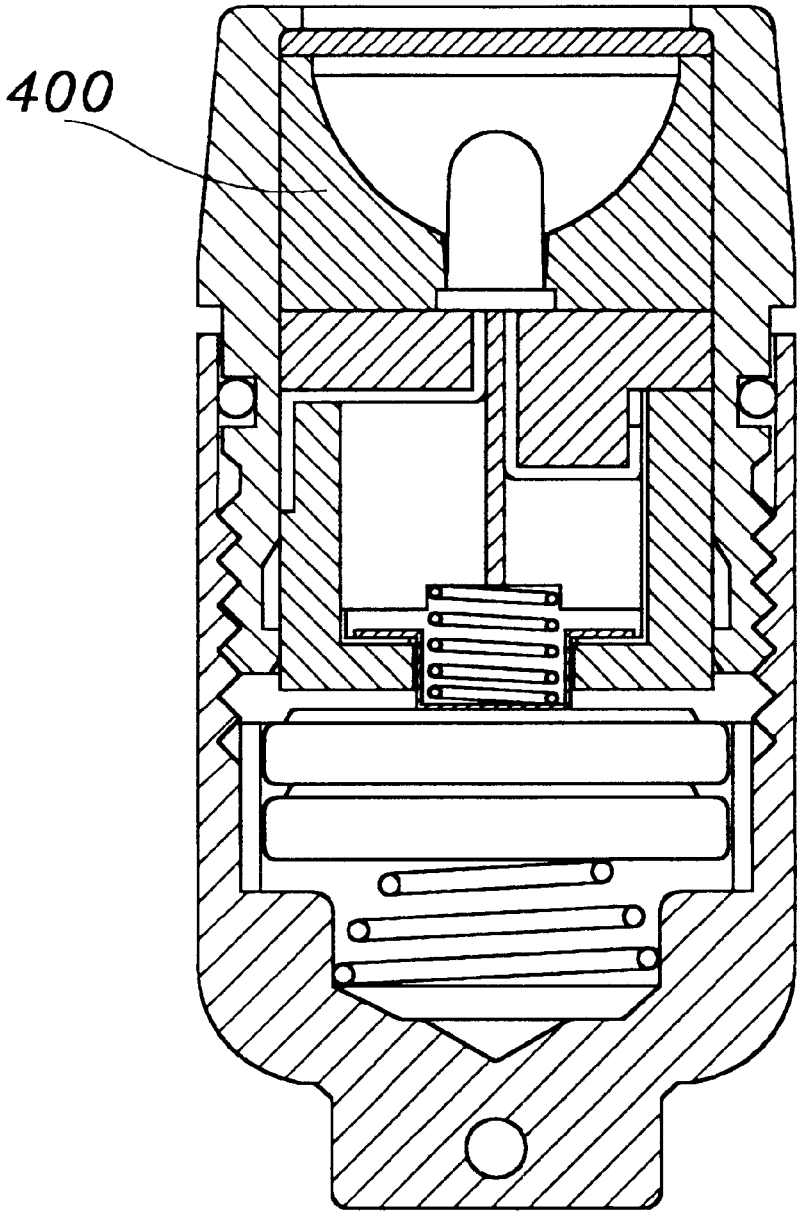
FIG. 12 is a sectional view of the third embodiment of the present invention showing the LED lamp bulb in its turning on state.
Figure 13:
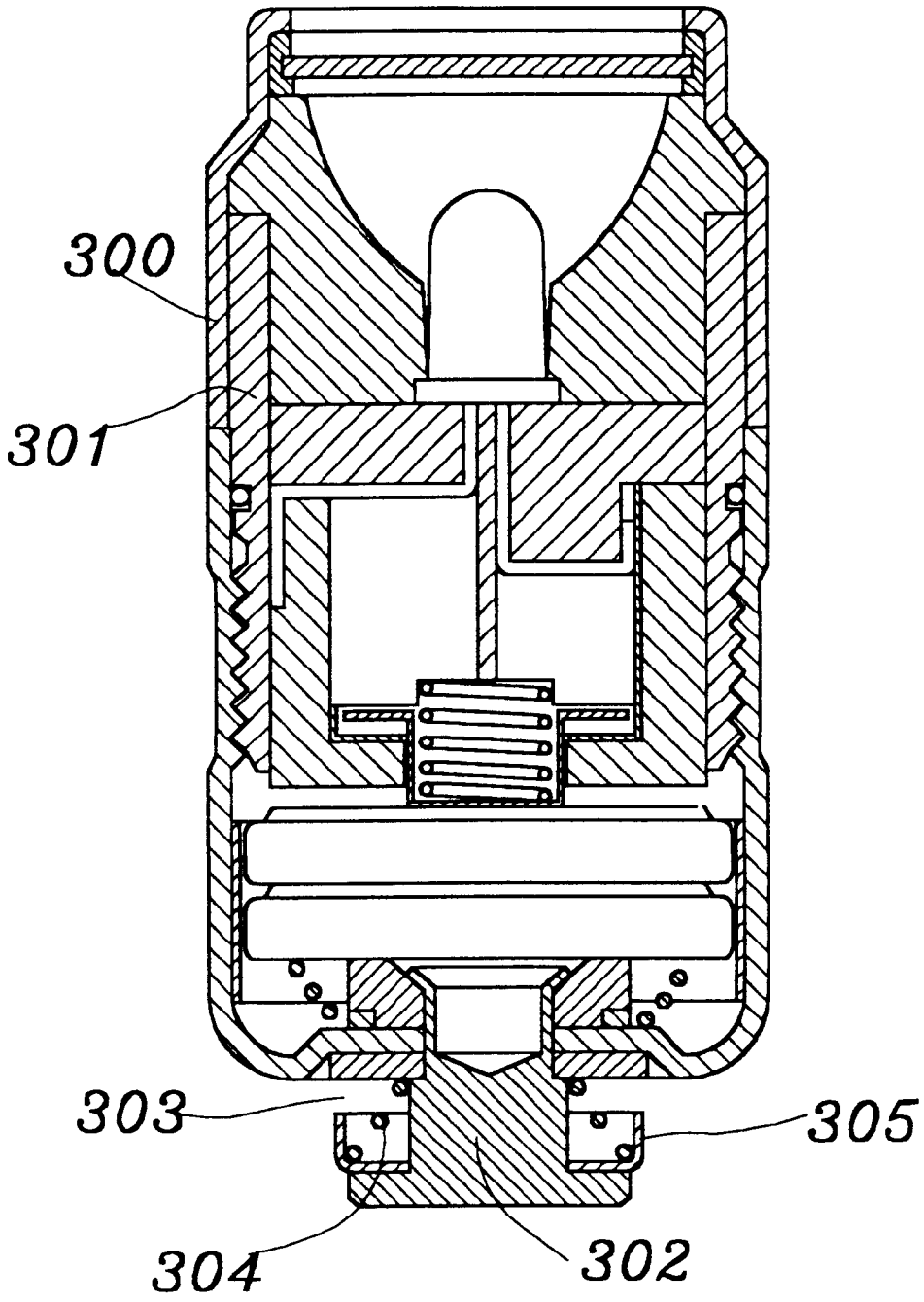
FIG. 13 is a sectional view of another embodiment against that shown in FIG. 12.

FIG. 12 shows a third embodiment of the present invention, it uses a reflecting condenser 400 in lieu of the transparent cover 40 in the first embodiment. FIG. 13 discloses another embodiment similar to that shown in FIG. 12, wherein, an end cover 300 can be composed of a metallic pipe and an alloy threaded pipe 301 (they are of different material); and the main barrel of the flashlight is provided by riveting on the bottom thereof with a connector 302. The connector 302 forms with the bottom surface of the flashlight a neck portion 303, a movable member 305 pressed against by a spring 304 is provided on the connector 302 around the neck portion 303, so that the flashlight can be conveniently assembled on some other article with this connector 302 by aiding of the elastic movable member 305.

Figure 14:
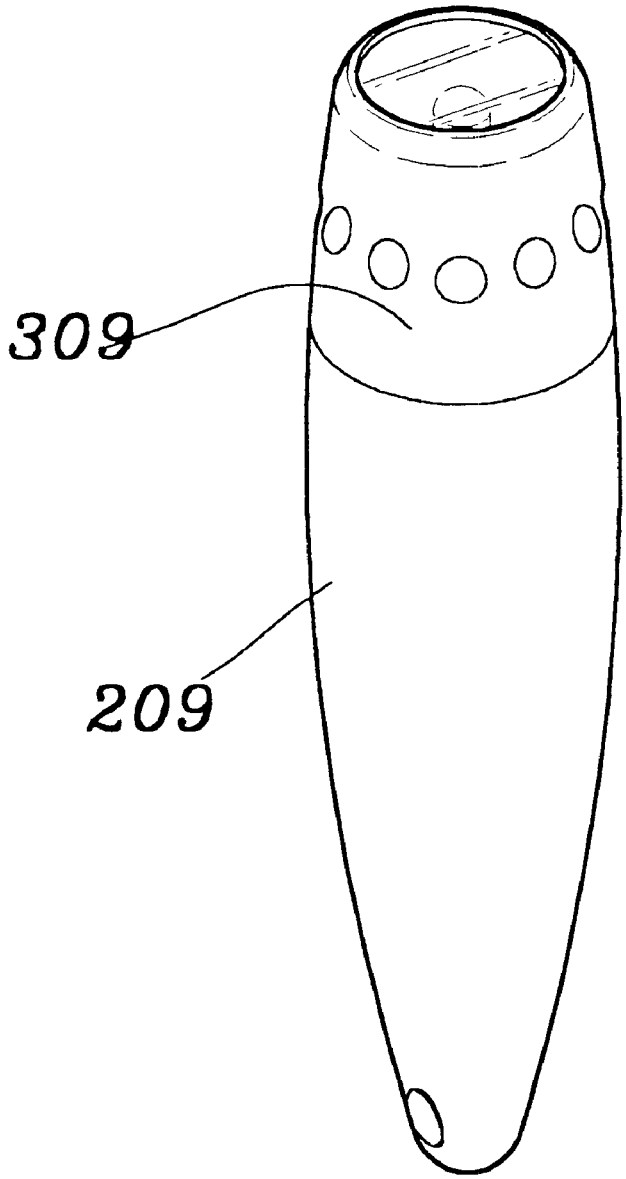
FIG. 14 is a perspective view of a further embodiment of the present invention showing the whole flashlight is integral in its contour.

FIG. 14 shows a further embodiment of the present invention, wherein, a main barrel 209 and an end cover 309 are also smoothly juxtaposed with each other as being integral in a straight contour or an arciform contour as shown.

The LED lamp bulb and the lamp holder as well as the switching device of the present invention are completely assembled in an end cover which can thus be connected directly with the main barrel to form a desired flashlight with two sections, the flashlight with the LED lamp bulb thereby is further minimized. By virtue that the LED lamp bulb and the lamp holder as well as the switching device can be assembled in the end cover following the same direction, operation in site can thus be faster and more convenient. The end cover can be connected with the main barrel by screwing; the connecting area of the flashlight can be tidy to appear the smooth and integral contour which can be any of various shapes. The switching device is moved by controlling of the electric conductive cap which is pressed interiorly, thereby, driving thereof interiorly can be stable and reliable. And the LED lamp bulb does not have a filament which is subjected to damage, thereby it can almost be a permanent lamp bulb. The main controlling members and the LED lamp bulb are all positioned in the metallic housing of the end cover, the LED lamp bulb can get more perfect covering protection regardless of whether it is in assembling or changing batteries, and hence the structural strength thereof can be better.

Having thus described my invention, what I claim as new and desire to be secured by letters patent of the United States are:

1. A flashlight carriable on one's person and comprising:

(a) a unitary, one piece, hollow main barrel having a sidewall, a closed end and an open end;

(b) a light emitting assembly removably attached to the open end of the main barrel so as to be removable as a unit, and including:

i) an end cover having a light penetrating hole through one end of the end cover;

ii) a female insulation sleeve located in the end cover, and having a hollow interior and a bottom wall with a central hole therethrough;

iii) a metallic electrically conductive element mounted on the bottom wall within the female insulation sleeve, the metallic electrically conductive element having central opening aligned with the central hole in the bottom wall, first and second conductor feet extending from opposite sides thereof, a length of the first conductor foot being greater than a length of the second conductor foot;

iv) a male insulation block on the female insulation sleeve, and having two through holes with a stepped portion communicating with each through hole;

v) a light emitting diode (LED) located in the end cover and having first and second electrodes extending therefrom, the electrodes extending through the two through holes in the male insulation block, each electrode engaging one of the stepped portions such that the first electrode contacts the end cover and the second electrode contacts the first conductor foot;

vi) an electrically conductive cap movably located in the female insulation sleeve having a portion extending through the central hole and the central opening, and an outwardly extending edge within the female insulation sleeve; and, vii) a biasing member acting on the electrically conductive cap so as to bias the cap in a position wherein the outwardly extending edge contacts the metallic electrically conductive element; and c) at least one battery located in the main barrel and having a terminal in contact with the electrically conductive cap, whereby movement of the light emitting assembly relative to the main barrel moves the electrically conductive cap between a first position wherein the outwardly extending edge contacts the electrically conductive element, thereby lighting the LED, and a second portion wherein the outwardly extending edge is displaced away from the electrically conductive element, thereby turning off the LED.

2. The flashlight of claim 1 further comprising:

a) a first threaded portion on the main barrel adjacent to the open end; and, b) a second threaded portion on the end cover, whereby the end cover is removably attached to the main barrel by engagement of the first and second threaded portion.

3. The flashlight of claim 1 further comprising a transparent cover located in the end cover, the transparent cover having a hollow interior in which the LED is located.

4. The flashlight of claim 1 further comprising a whistle device formed in the closed end of the main barrel.

5. The flashlight of claim 1 further comprising a reflecting condenser located in the end cover through which the LED extends.

6. The flashlight of claim 1 further comprising a connector on the closed end of the main barrel, the connector having a movable member.

* * * * *